United States Patent [19]

Sanfilippo

[11] 4,222,302

[45] Sep. 16, 1980

[54] BOW GUIDE FOR A STRINGED INSTRUMENT

[76] Inventor: Margherita Sanfilippo, 1188 Westwood Dr., San Jose, Calif. 95125

[21] Appl. No.: 63,034

[22] Filed: Aug. 2, 1979

[51] Int. Cl.[3] ..... G10D 3/16

[52] U.S. Cl. ..... 84/283

[58] Field of Search ..... 84/281, 283, 453, 465

[56] References Cited

U.S. PATENT DOCUMENTS

| | | | |
|---|---|---|---|
| 1,192,030 | 7/1916 | Ashley | 84/283 |
| 1,325,251 | 12/1919 | Keles | 84/283 |
| 1,723,266 | 8/1929 | Caruso | 84/283 |

*Primary Examiner*—Lawrence R. Franklin

*Attorney, Agent, or Firm*—Gerald L. Moore

[57] ABSTRACT

A training attachment for a stringed instrument which is fixed in the F holes to extend across the strings and serve as a guide for assuring the correct use of the bow.

3 Claims, 4 Drawing Figures

BOW GUIDE FOR A STRINGED INSTRUMENT

BACKGROUND OF THE INVENTION

In the playing of stringed instruments, it is important to draw the bow in a straight line and at the proper position at right angles to the strings with the approved arm and wrist movement. Frequently the beginning player has so many things to remember that it is difficult to keep the bow at right angles to the strings. Various attachments have been provided in the past to assist the student in this regard. Some of these attachments are disclosed in the U.S. Pat. Nos. 1,192,030, Ashley, issued on July 25, 1916 and 2,782,670, Lipski, issued on Feb. 26, 1957. Also the French Pat. No. 588732 which issued on Mar. 14, 1925 and the German Pat. No. 67105 which issued on Nov. 25, 1914, show such attachments.

It is the purpose of the present invention to provide an improved attachment which is simple in design yet effective in operation in teaching the student to properly draw the bow across the strings of a stringed instrument.

SUMMARY OF THE INVENTION

A training attachment for a stringed instrument having F holes positioned to each side of the strings comprising the combination of a guide extending across and normal to the strings adjacent the contact area for the bow. Attachments fixed to the ends of the guide are sized to fit within the F holes of the instrument for holding the guide in position extending above and across the strings whereby the player in drawing the bow across the strings in contact with and parallel with the guide learns the proper method of drawing the bow.

DESCRIPTION OF THE INVENTION

Figure 1:
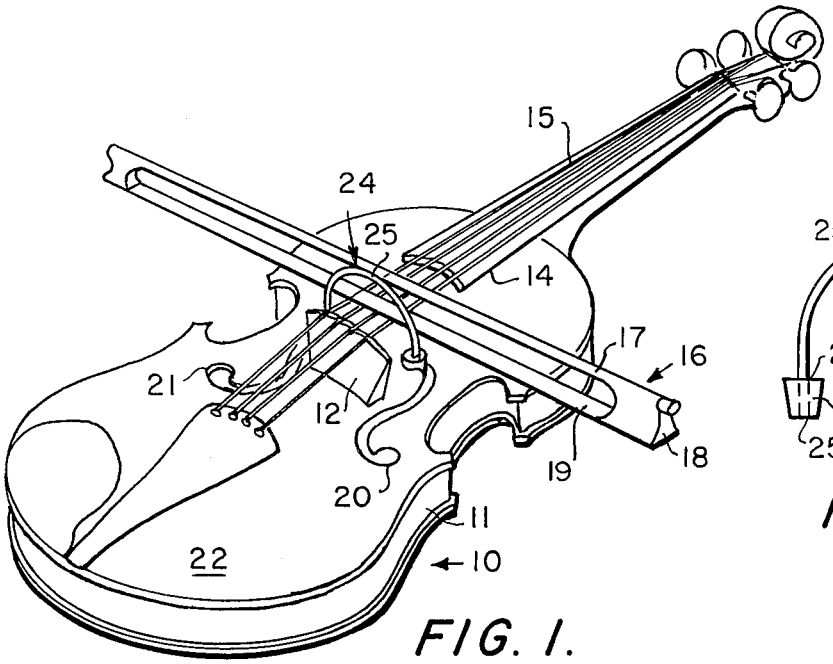
FIG. 1 is a perspective view of a violin and bow with the subject invention attached to the violin.
Figure 4:
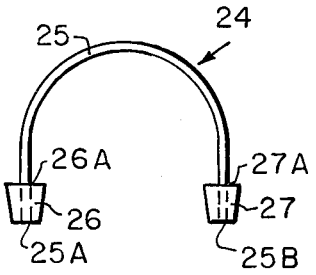
FIG. 4 is an enlarged view of the bow guide.

As shown in FIG. 1 the invention is used with a violin 10 including a body 11, a bridge 12, a fingerboard 14 and the four strings 15 of the usual construction. The instrument is played by drawing a bow 16 perpendicularly across the strings. The bow comprises a bow stick 17 having the fingerhold 18 on one end and supporting the bow hair 19.

In playing the instrument, the bow is drawn across the strings bringing the bow hair 19 into contact with the strings. The violin is of the usual construction with the hollow body and a pair of F holes 20 and 21 in the top surface 22 of the body and on opposite sides of the strings. These F holes terminate with enlarged openings 20A and 21A respectively, in one end positioned generally between the bridge and the fingerboard.

It is important that the bow be drawn across the strings at a position between the bridge and the fingerboard and in a direction perpendicular to the strings. Frequently beginners tend to draw the bow diagonally across the strings and sometimes in a position too near the bridge or the fingerboard. In accordance with the present invention there is provided a guide 24 which extends above and across the strings. This guide extends perpendicular to the strings and serves as a guide against which the bow can be drawn to remind the beginner of the proper positioning of the bow.

In its preferred embodiment the guide comprises a wire 25 which is coated with a suitable plastic material both for providing a nonabrasive surface against which the bow stick can be rubbed and for appearance. The guide is generally formed in a U-configuration with a plug or cork 26 and 27 fixed to the ends respectively. The plugs include center openings 26A and 27A, respectively, into which can be fitted the ends 25A and 25B of the wire. Preferably these ends are glued or otherwise fastened into the plugs.

Figure 2:
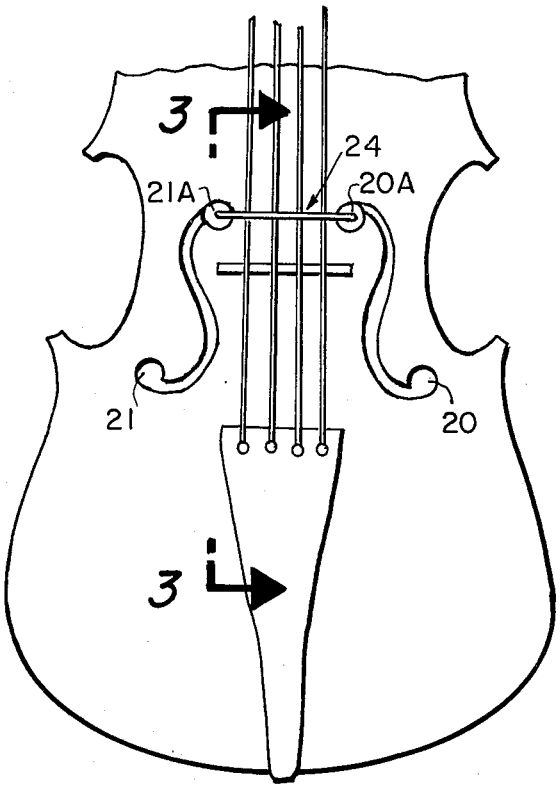
FIG. 2 is a partial top view of the violin with the attachment in place.
Figure 3:
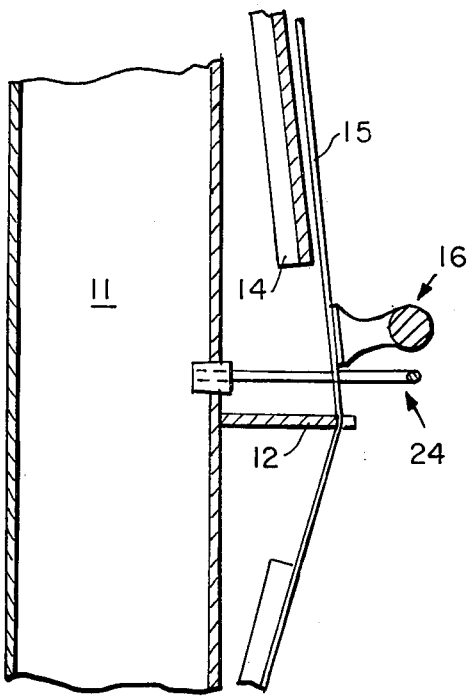
FIG. 3 is a cross-sectional view along the line 3—3 of FIG. 2.

The plugs are sized to fit into the end openings 20A and 21A of the F openings 20 and 21. When fitted therein, the guide 25 extends above the strings in the manner shown in FIGS. 1, 2 and 3 immediately adjacent the position across which the bow should be drawn. By use of the F holes to support the guide, no special support need be provided on the violin. In addition the guide can be removed whenever desired.

The coated wire offers a slight resistance when the bow stick is drawn against it. A different "feel" results if the bow stick is not flat against the guide. Thus the student is provided an indication of when the bow is being drawn properly across the strings without actually viewing the bow and guide. While this guide has been shown and described with the violin, it should be understood that it can be used with equally beneficial results on other stringed instruments such as viola, cello, and the string bass, with an enlarged modification of the bow guide to fit the F holes of each stringed instrument.

The invention claimed:

1. In combination with a stringed instrument having a top surface with F holes therein and supporting the strings of the instrument which are stroked by a bow, a guide comprising:

a rigid member formed in a U-configuration for extending between the F holes and above the strings of the instrument; and a plug fixed to each end of the rigid member and sized to fit into the adjacent F hole to support the rigid member on the instrument for guiding the bow as it is drawn across the strings.

2. The combination as defined in claim 1 wherein the rigid member is a wire bent into a U-configuration.

3. The combination as defined in claim 2 wherein the wire is coated with a plastic material.

* * * * *